US006705448B1

(12) United States Patent
Steel

(10) Patent No.: US 6,705,448 B1
(45) Date of Patent: Mar. 16, 2004

(54) METHOD AND APPARATUS FOR VALIDATING CURRENCY

(75) Inventor: Paul Franklin Steel, Barkham (GB)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 09/762,612

(22) PCT Filed: Aug. 13, 1999

(86) PCT No.: PCT/GB99/02682

§ 371 (c)(1),
(2), (4) Date: Mar. 30, 2001

(87) PCT Pub. No.: WO00/10138

PCT Pub. Date: Feb. 24, 2000

(30) Foreign Application Priority Data

Aug. 14, 1998 (GB) ..... 9817822

(51) Int. Cl.[7] ..... G07D 5/00

(52) U.S. Cl. ..... 194/302; 194/304; 194/320; 194/334

(58) Field of Search ..... 194/302–306, 194/317–325, 334, 335, 339; 453/2, 4

(56) References Cited

U.S. PATENT DOCUMENTS

| | | | | |
|---|---|---|---|---|
| 4,204,765 A | | 5/1980 | Iannadrea et al. | |
| 4,255,057 A | | 3/1981 | Williams | |
| 5,236,071 A | * | 8/1993 | Lee | 194/200 |
| 5,662,205 A | * | 9/1997 | Levasseur | 194/317 |
| 5,715,926 A | * | 2/1998 | Furneaux et al. | 194/317 |
| 5,729,623 A | | 3/1998 | Omatu et al. | |
| 5,757,001 A | | 5/1998 | Burns | |
| 6,398,001 B1 | * | 6/2002 | Hutchinson et al. | 194/317 |

FOREIGN PATENT DOCUMENTS

| | | | |
|---|---|---|---|
| EP | 0 364 079 A2 | | 4/1990 |
| EP | 0 692 773 A2 | | 1/1996 |
| GB | 2 211 337 A | | 6/1989 |
| GB | 2 266 399 A | | 10/1993 |
| GB | 2 323 200 A | | 9/1998 |
| WO | WO 86/06246 | * | 11/1986 |

* cited by examiner

*Primary Examiner*—Dean J. Kramer
(74) *Attorney, Agent, or Firm*—Fish & Richardson P.C.

(57) ABSTRACT

Coins may be validated and denominated by comparing varying signals from coin sensors and checking whether a predetermined relationship between them is maintained, for example, as the coin moves past die sensors. In some implementations, each varying signal may represent the varying effect on a sensor as the coin moves relate to the sensor.

21 Claims, 2 Drawing Sheets

METHOD AND APPARATUS FOR VALIDATING CURRENCY

BACKGROUND OF THE INVENTION

This invention relates to a method and an apparatus for validating articles of currency, particularly coins.

It is known to validate coins by monitoring the outputs of a plurality of sensors each responsive, to different characteristics of the coin, and determining that a coin is valid only if all the sensors produce outputs indicative of a particular coin denomination. Often, this is achieved by deriving from the sensors particular values indicative of specific parts of the sensor signal. For example, an electromagnetic sensor may form part of an oscillator, and the amplitude of the oscillations may vary as a coin passes a sensor. In some arrangements, the peak value of the amplitude variation is used as a parameter indicative of certain coin characteristics, and this value is compared with respective ranges each associated with a different coin denomination. Sometimes other features of the output waveform are examined. Often coins travel past sensors under the force of gravity, e.g. by rolling, or in free fall, while the measurements are made. Because the coin position at any given instant is indeterminate, the sensor waveforms are monitored to observe when the particular feature of interest occurs.

It would be desirable to provide an improved validation technique which derives further information from the outputs of the sensors.

Some coins are formed of a composite of two or more materials, and have an inner disc surrounded by an outer ring, the disc having a different metallic content from that of the outer ring. Often, each of the inner disc and the outer ring is of an homogeneous metal, but it would be possible for one or the other or both to be formed of two or more metals. For example, the inner disc may be formed of a core material with outer cladding of a different material. Coins which have an inner disc of different material content to that of a surrounding ring will be referred to herein as "bicolour" coins. (This expression is intended to encompass the possibility of any number of rings of different materials.) WO-A-93/22747 describes a technique for validating bicolour coins in which two small sensors are located at positions spaced along a coin ramp so that they are passed in succession by a coin rolling along the ramp. A sensor circuit is responsive to the difference between the outputs. This permits easy recognition of bicolour coins, because a significant differential output is produced when one sensor is located in proximity to the coin ring, and the other is located in proximity to the inner disk. However, this arrangement requires a special sensor configuration.

It would be desirable to provide an improved validation technique which is particularly, but not exclusively, suitable for bicolour coins.

It would also be desirable to provide a novel and useful technique for validating banknotes and the like.

SUMMARY OF THE INVENTION

According to a further aspect of the invention, articles of currency are validated by taking sensor signals which represent different sensed characteristics of a currency article being scanned, and determining whether there is a predetermined relationship between the patterns of variation of the signals.

According to a still further aspect, currency articles are validated by determining whether a predetermined relationship is maintained between at least three varying signals each derived from a sensor scanning the article.

According to a yet further aspect, currency articles are validated by determining whether successive changing values of a signal derived from a sensor bear a predetermined relationship with successive changing values of a different sensor signal.

The various sensor signals may be derived from respective sensors, although it is also possible for some or all to be derived from the same sensor.

The techniques of the present invention thus enable, in a coin validator, the validation operation to take into account parts of the sensor output waveforms which are traditionally ignored, these parts containing useful information regarding the coin, and being of value in the authentication of the coin despite the fact that the times at which they occur may be indeterminate.

In a currency validator according to a preferred embodiment, samples of the signal from one sensor are combined in a predetermined manner with corresponding samples from another sensor. The corresponding samples are preferably samples which occur at substantially the same time. The samples can be combined in any of a number of different ways, but preferably the result of the combination is the production of an output value which indicates whether or not the relationship between the varying sensor signals departs from a predetermined relationship expected for a currency article of a particular denomination. (To check for different denominations, the validator can check to determine whether different predetermined relationships are met.) Preferably, the samples are combined by summing weighted values of the samples and then, preferably, applying the sum to a non-linear function. Preferably, the samples from one of the sensors, or more preferably two or more of the sensors, are combined in a predetermined way in order to produce an output value which varies according to an expected variation in the signal from a further sensor, and means are provided to check whether the output value and the signal from the further sensor match.

The summing of the weighted samples, and the application of the result to a non-linear function, can be performed a number of times, using different weights, with the outputs of the non-linear functions also being combined in a weighted manner.

To derive the weighting factors, a neural network can be trained in a per se known manner, e.g. using back propagation.

The neural network may be embodied as a suitably-programmed microprocessor. Alternatively, the neural network may be embodied as hardware, responsive either to discrete samples of the sensor signals or to the continuous outputs.

While neural networks provide a rapid method of generating an algorithm to process the data algorithms could obviously be developed by other methods to provide discrimination between numerical representations of the waveforms. Analysis would lead to an understanding of the relationships between the sensor outputs and the known form of the currency article giving rise to the signal. The outputs could be analysed in combination to discover deeper interrelationships. Non linearities might be accommodated by use of power laws, logarithms, trigonometrical or other functions. Regression techniques could be employed, for example, with polynomials to develop a model which ultimately relates the waveforms. These approaches would work, but use of a neural network is preferred because it leads to a fast and sufficiently effective result which is simple to incorporate in a product.

A significant advantage of the arrangement described above is that validation of currency articles can take advantage of non-obvious correlations between parts of the sensor signals which are not normally taken into account, and particularly, correlations between the changing parts of the signals.

A further advantage of the arrangement described above is that the determination of whether the predetermined relationship exists between the varying signals is not dependent on the speed of the currency article relative to the sensors. Any delays in the time at which particular sensor output values are reached due to a slow-moving article will be matched by delays in the signals from the other sensors. However, in this arrangement, it is desirable for the sensors to be positioned such that for each sensor there is a period in which its output and that of another sensor are simultaneously influenced by an article being tested (although of course there may be other sensors whose outputs are disregarded for the purpose of determining whether the predetermined relationship is maintained). On the other hand, it may be desirable for at least one sensor to be arranged such that it is not influenced at the same time as any other sensor, when at least one type of genuine article is being tested, so that if it is found to be influenced while one or more other sensors are also influenced, this is an indication that the article being tested is not an article of that type.

In an alternative embodiment, instead of combining substantially contemporaneous samples, the output from a sensor during one period can be compared with the output for a different sensor during a different period. This then avoids any restrictions on the relative placement of the sensors. Also, taking electromagnetic coin sensors as an example, this alternative would enable the comparison of the parts of the sensor outputs which contain the most important information, which can often be the centre parts of the waveforms, without placing any particular restriction on the relative positioning of the sensors. However, in this case the determined relationship between the sensor signals would be influenced by variations in the speed of the article. To compensate for this, the validator can be arranged to compare samples from one sensor output with delayed samples from another sensor output, the delay period being varied in accordance with the sensed movement (e.g. position, speed and/or acceleration) of the article. In an alternative embodiment a controller controls both the movement of the article and the sampling of the sensor signal.

Preferably, further checks are carried out on the sensor outputs to determine whether they meet other acceptance criteria, in a per se known manner. For example, with electromagnetic coin sensors, the peak levels can be compared with expected ranges for respective denominations. Instead of using the peak levels directly, it is possible to normalise by using the relationship (e.g. the difference or the ratio) between the peak levels and the values of the sensor signals with no coin present. The peak values from different sensors can be combined in a predetermined manner before applying acceptance criteria (e.g. as shown in EP-A496 754).

BRIEF DESCRIPTION OF THE DRAWINGS

Arrangements embodying the invention will now be described by way of example with reference to the accompanying drawings, in which.

DETAILED DESCRIPTION

Figure 1:
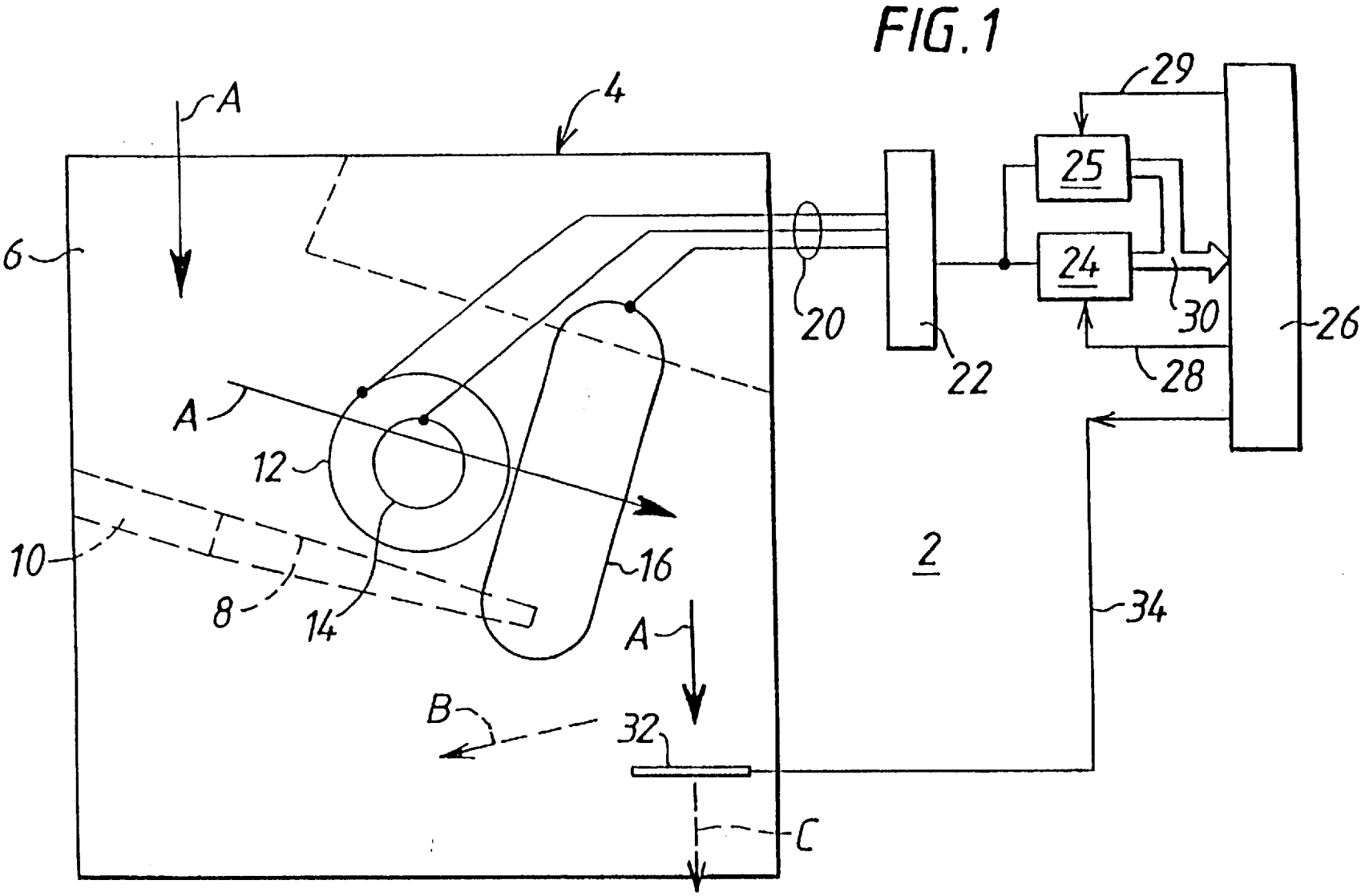
FIG. 1 schematically shows a coin validator in accordance with the invention.

Referring to FIG. 1, the validator 2 comprises a test structure 4. This structure comprises a deck (not shown) and a lid 6 which is hingedly mounted to the deck such that the deck and lid are in proximity to each other. FIG. 1 shows the test structure 4 as though viewed from the outer side of the lid. The inner side of the lid is moulded so as to form, with the deck, a narrow passageway for coins to travel edge first in the direction of arrows A.

The moulded inner surface of the lid 6 includes a ramp 8 along which the coins roll as they are being tested. At the upper end of the ramp 8 is an energy-absorbing element 10 positioned so that coins received for testing fall on to it. The element 10 is made of material which is harder than any of the coins intended to be tested, and serves to remove a large amount of kinetic energy from the coin as the coin hits the element. The energy-absorbing element may be structured and mounted as shown in EP-A-466 791.

As the coin rolls down the ramp 8, it passes between inductive sensors formed by three coils 12, 14 and 16 mounted on the lid, and a corresponding set of coils (not shown) of similar configuration and position mounted on the deck, forming three pairs of opposed coils. The coin is subjected to electromagnetic testing using these coils.

The coils are connected via lines 20 to an interface circuit 22. This interface circuit 22 comprises oscillators coupled to the electromagnetic coils 12, 14 and 16, circuits for appropriately filtering and shaping the signals from lines and a multiplexing circuit for delivering any one of the signals from the three pairs of coils to an analog-to-digital converter 24 and to a counter 25.

A control circuit 26, including a microprocessor, has an output line 28 connected to the analog-to-digital converter 24, and is able to send pulses over the output line 28 in order to cause the analog-to-digital converter 24 to take a sample of its input signal and provide the corresponding digital output value on a data bus 30, so that the amplitude of the signal applied to the analog-to-digital converter 24 can be measured.

The control circuit 26 also has an output line 29 which can start and stop the counter 25, so that the oscillations of the signal applied to the counter 25 can be counted for a predetermined period, whereby the frequency of the signal is converted to a digital value provided on the data bus 30 to the control circuit 26.

In this way, the control circuit 26 can obtain digital samples from the test structure 4, and in particular from the coils 12, 14 and 16, and can process these digital values in order to determine whether a received test item is a genuine coin or not. If the coin is not determined to be genuine, an accept/reject gate 32 will remain closed, so that the coin will be sent along the direction B to a reject path. However, if the coin is determined to be genuine, the control circuit 26 supplies an accept pulse on line 34 which causes the gate 32 to open so that the accepted coin will fall in the direction of arrow C to a coin separator (not shown), which separates coins of different denominations into different paths and directs them to respective coin stores (not shown).

In this embodiment, a single analog-to-digital converter 24 and a single counter 25 are used in a time-sharing manner for processing the signals from the coils 12, 14 and 16. However, a plurality of converters and counters could be provided if desired.

Figure 2:
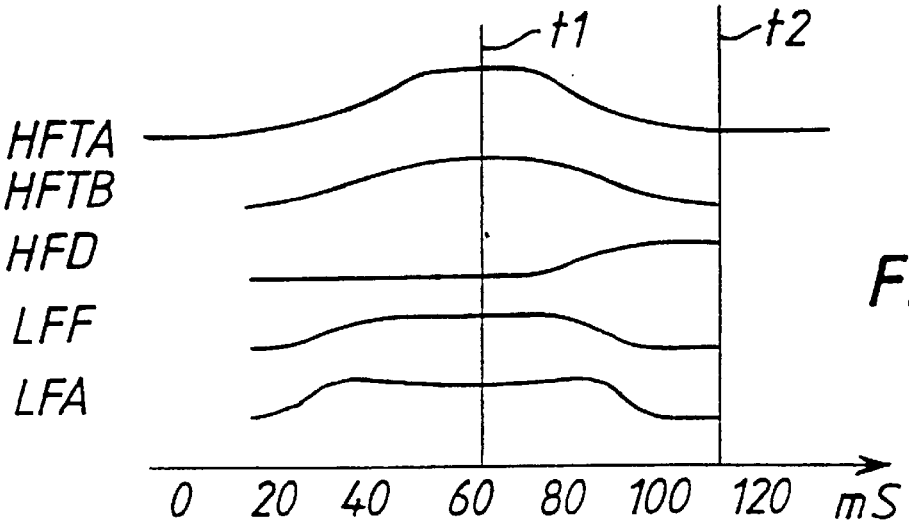
FIG. 2 is a diagram illustrating the outputs of coin sensors.

Referring to FIG. 2. this shows a set of exemplary outputs from the sensors. HFTB represents the change in frequency of the oscillations of the oscillator including the coil 12. The corresponding coil (not shown) on the deck is incorporated in a separate oscillator, and HFTA represents the change in the frequency of the oscillations of that oscillator.

LFF represents the change in frequency of the oscillations of the oscillator driving the coil 14 and its deck counterpart. LFA represents the change in the attenuation of these oscillations.

HFD represents the change in frequency of the oscillations of the oscillator driving the coil 16 and its deck counterpart.

It will be noted that, because the coil 14 is mounted concentrically within the coil 12, the waveforms HFTA, HFTB. LFF and LFA are all symmetrical about a common point on the time axis, labelled t1. The peak value of the output HFD, however, occurs at a later time labelled t2.

The control circuit 26 is operable to use well known peak-detection techniques to detect the occurrences of the times t1 and t2. The control circuit is further operable to use the values of HFTA. HFTB. LFF and LFA at t1, and the value of HFD at t2, to assess the validity and denomination of the received coin. In this embodiment, the values HFTA and HFTB at time t1 are used to provide a measurement which is predominantly determined by the thickness of the coin, the values LFF and LFA at t1 represent predominantly material measurements of the coin and the value HFD at t2 represents predominantly the diameter of the coin. However, as in all electromagnetic coin measurements, although the sensors may be so arranged as to provide an output predominantly dependent upon a particular parameter, each measurement will be affected to some extent by other coin properties. In this case, all five of the sensor signals are influenced by different (although possibly related) characteristics of the coin, by virtue of the fact that they are derived from sensors which have a different physical relationship with the passing coin or by virtue of the fact that they are derived from different signal parameters (e.g. amplitude as distinct from frequency).

In addition, the control circuit 26 is arranged to monitor the relationship between the five signals during the interval t1 to t2, and to use this determined relationship as a further indication of the validity and denomination of the received coin.

The coin is determined to be a valid coin of a particular denomination provided none of the tests indicates that the coin is not of that denomination.

In order to determine the relationship between the different waveforms, each sample from each waveform is processed with corresponding samples from the other waveforms in the manner described below. A corresponding set of samples in this embodiment comprises samples which are taken at substantially the same time. The samples may not be taken at precisely the same time, especially if the analog-to-digital converter 24 and counter 25 are used in a time-shared manner, but the interval between the samples from the different waveforms is sufficiently short that the results are not significantly influenced by changes in coin speed.

Figure 3:
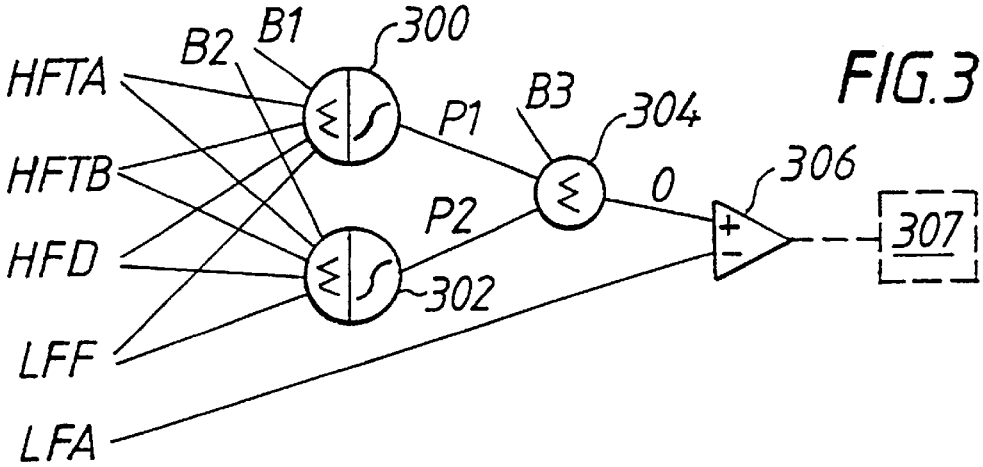
FIG. 3 is a diagram illustrating the manner in which the data samples derived from the sensors are processed.

FIG. 3 illustrates the processing of a single set of corresponding samples from the respective sensors. A first process, schematically illustrated by the neuron 300, takes the values from signals HFTA, HFTB, HFD and LFF and multiplies each one by a respective predetermined weight and then sums them with a bias value B1. The sum is then applied to a non-linear function, for example a sigmoid function or a hyperbolic tangent function, to provide an output value P1.

A second process illustrated by neuron 302 performs a similar operation, except using different weights and a different bias value B2, to produce an output value P2.

A third process is illustrated by a summing junction 304 and multiplies each of the output values P1, and P2 by a respective weight and adds these to a bias value B3 to produce an output value O.

The weights and the bias values are associated with a particular coin denomination, and are so chosen that the output value O varies in a substantially similar manner to the expected variations in the signal LFA, for a coin of that denomination.

The output value O and the sample of the signal LFA are compared in a difference amplifier 306. If the amplifier 306 indicates a significant difference between these values, i.e. if its output differs significantly from zero, the control circuit 26 determines that the received coin does not correspond to the denomination currently being checked.

If desired, the output of the difference amplifier 306 could be delivered to an integrator 307, the output of which is tested after the coin has passed the sensors, so that the coin is determined not to be of a particular denomination only if the differences accumulated over a particular period exceed a predetermined level.

The process is then repeated, using different weights and different bias values associated with a different coin denomination.

After the control circuit 26 has performed the checking operation on the set of samples for all the denominations to be tested by the validator, the next set of corresponding samples is checked in the same way. The process is then repeated, using all the samples between the intervals t1 and t2. If, at any time, the difference amplifier 306 produces an output indicating a significant difference between its input values, the control circuit 26 stores an indication that the coin does not correspond to the denomination being checked. If desired, any subsequent processing to check for that particular denomination can be omitted.

The weights and the bias values used in the processing illustrated in FIG. 3 can be derived using an iterative training process. Conventional neural network techniques, such as back propagation, can be used. Samples of genuine coins would be repeatedly tested, while the weights and bias values are modified to minimise the difference between the output 0 and the varying LFA signal. Preferably, counterfeit coins are also used in the training process, and the weights are selected to increase the difference between the predicted LFA signal for the genuine coin and that for a known counterfeit.

The training operation can be performed after assembly of the coin validator using a training procedure on each individual validator. Preferably, however, a number of "reference" validators are used in the training process, and common values for the weights and biases are adjusted so that they are suitable for each such validator. These values are then used in production validators, so that individual training is not necessary.

The processing illustrated in FIG. 3 can be varied considerably. The neurons 300 and 302 represent a hidden layer.

If desired, there could be additional neurons in this layer, or one or more additional layers, or the layer can be omitted. The non-linear functions performed by these neurons can be omitted, or a further non-linear function can be added to the neuron 304. Instead of combining the weighted samples before applying the sum to a non-linear function, non-linear functions can be applied to the samples prior to combining them. Instead of using simple weighting and summing operations, other techniques can be used for processing and combining the individual values.

The processing of FIG. 3 results in the combining of four sensor outputs in order to predict a fifth sensor output. Instead, all the sensor outputs could be input to the neurons 300 and 302, and the weights set to achieve a predetermined output value O. In this case, however, measures should be taken during the training process to ensure that the weights do not converge on zero.

As a further alternative, assuming that there are n sensor outputs, it may be possible to predict any number, or indeed all n, of these, each prediction preferably being based on the remaining n-1 sensor outputs. An error signal can then be derived by for example taking the mean of the squares of the individual errors for each predicted signal.

Figure 4:
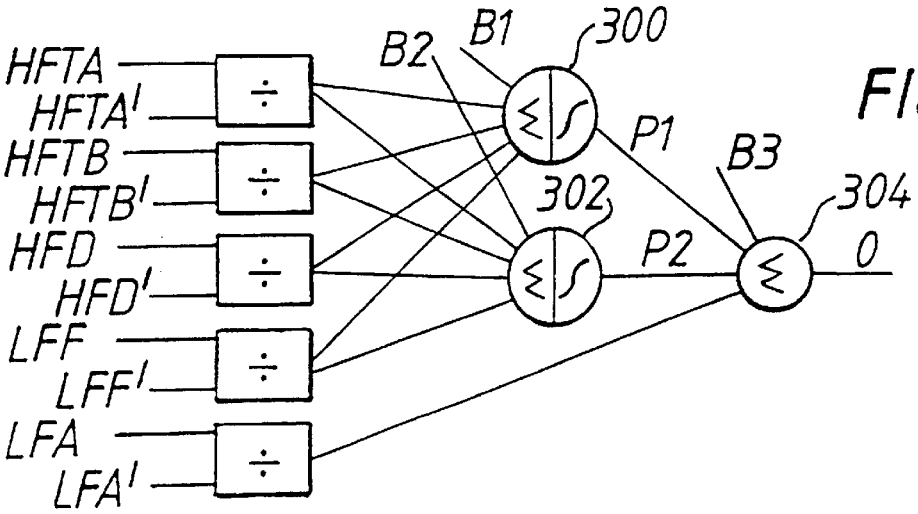
FIG. 4 is a diagram illustrating an alternative processing technique.

FIG. 4 shows a modified version of the processing technique of FIG. 3. The control circuit 26 stores in a conventional manner acceptance criteria comprising data representing the expected peak values of the different signals for different denominations, so that these data can be used in checking the peak values as discussed above. In the FIG. 4 arrangement, each of the sensor sample values HFTA, HFTB, HFD, LFF and LFA, is divided by the expected peak value. HFTA', HFTB', HFD', LFF', LFA', for the denomination being checked. This normalises the value, and thus makes it easier to use weights and bias values which are common for different validators.

FIG. 4 also illustrates that the LFA values can be fed to the summing junction 304, instead of using a discrete difference amplifier 306. In this case, the output O of summing junction 304 will adopt a level indicative of how close the relationship between the samples being checked is to the expected relationship for the denomination being checked. This output can be checked, possibly after integration as in the FIG. 3 arrangement.

Because the sensor outputs are symmetrical about the peak value, the checking of the trailing halves of the waveforms HFTA. HFTB, LFF and LFA and the leading half of the waveform HFD represents a particularly efficient method of comparison, in that there is no loss of information by omitting the other halves of the waveforms. Also, this may avoid problems resulting from the use of the HFD waveform, which is asymmetric with respect ot $t_1$, and which therefore would tend to cause errors if used in predicting values which are symmetric with respect to $t_1$.

It will be appreciated that the relationship between the output signals of differently-positioned sensors will be influenced by the size of the coin. It is conventional to use a coin sensor which is designed to be particularly sensitive to coin diameter. However, using the techniques of the present invention, it may be possible to eliminate such a dedicated sensor.

Coins which are made of different materials, and particularly coins which have a material content which varies in the radial direction such as bicolour or tricolour coins, generate sensor output signals which are more complex than homogenous coins. The technique of the present invention is therefore particularly advantageous in validating such inhomogenous coins, because it is sensitive to the profile of the output signal throughout a continuous period.

In an alternative embodiment, the samples of the waveforms HFTA, HFTB, LFF and LFA are delayed before being processed as indicated in FIG. 3 or FIG. 4 with the HFD samples. The delay could for example be such that the peak samples taken at time t1 of waveforms HFTA, HFTB, LFF and LFA are processed with the peak sample of HFD taken at time t2. By introducing a delay, the relative positioning of the sensor coils 12, 14 and 16 is less important. However, the appropriate delay period will depend upon the speed of the coin. Accordingly, the control circuit 26 in this embodiment would have means for adjusting the delay period in accordance with the movement of the coin. This movement can be detected by appropriate analysis of the signal(s) from one or more of the same sensors, or additional sensors, e.g. optical sensors, can be provided for this purpose. The selection of the signal samples to be processed can be triggered in accordance with the detected position of the coin. Alternatively, the delay period can be calculated from a signal indicating the speed of the coin. In a more sophisticated version, the delay period also takes into account the detected acceleration or deceleration of the coin.

If desired, the validator can have an automatic re-calibration function, sometimes known as "self-tuning", whereby the weights (and possibly bias values) are regularly updated on the basis of measurements performed during testing (see for example EP-A-0 155 126, GB-A-2 059 129, and US-A4 951 799).

These embodiments have been described in the context of coin validators, but it is to be noted that the term "coin" is employed to mean any coin (whether valid or counterfeit), token, slug, washer, or other metallic object or item, and especially any metallic object or item which could be utilised by an individual in an attempt to operate a coin-operated device or system. A "valid coin" is considered to be an authentic coin, token, or the like, and especially an authentic coin of a monetary system or systems in which or with which a coin-operated device or system is intended to operate and of a denomination which such coin-operated device or system is intended selectively to receive and to treat as an item of value.

Although the embodiments described above use signals derived from a plurality of sensors, as is preferred, it would alternatively be possible to use only a single sensor, producing a plurality of measurements of different characteristics.

The processing described in connection with banknote validation can be modified in the same way as discussed in relation to the processing described in connection with coin validation, for example by using the techniques described in connection with FIG. 4.

In the above embodiments, a single set of weights and biasses is used for each denomination being tested. Instead, it would be possible to use a plurality of sets of weights and/or biasses for each denomination, so that they are changed as the currency article moves relative to the sensors. The arrangement may be such that the processor switches from one set of weights and biasses to another set as the currency article is determined to have reached a particular position. For example, the switching of weights may be triggered by a peak value in a sensor output.

The present invention is applicable to currency validation using other types of sensors, for example capacitive or optical coin sensors, etc.

In all the above embodiments, the currency article is scanned by its movement past one or more fixed sensors, thus producing a plurality of varying signals. Obviously, the sensor or sensors can be moved, rather than the currency article. Furthermore, the varying signals can be produced by a scanning operation which does not require any such relative movement. For example, in a coin validator, a varying measurement signal could be obtained by varying the frequency applied to an inductive sensor.

What is claimed is:

1. A method of validating a coin, the method comprising determining whether a predetermined relationship is maintained between corresponding parts of at least two varying signals that occur during periods when the signals are varying, the signals representing measurements of different characteristics and each derived from a sensor scanning the coin.

2. A method as claimed in claim 1, the method comprising determining whether the predetermined relationship is maintained between at least three varying signals.

3. A method as claimed in claim 1, wherein the signals are derived from respective sensors.

4. A method as claimed in claim 1, wherein each varying signal represents the varying effect on a sensor as the article moves relative to the sensor.

5. A method as claimed in claim 1, wherein the step of determining whether the predetermined relationship is maintained is performed by sampling the signals, and comparing samples of the respective signals.

6. A method as claimed in claim in claim 1, wherein the step of determining whether the predetermined relationship is maintained is performed by combining the signals in a weighted manner.

7. A method as claimed in claim 6, wherein the weights have been derived using an iterative training process involving the measurement of genuine coins.

8. A method as claimed in claim 7,wherein the training process also involves the measurement of counterfeit coins.

9. A method as claimed in claim 1 including the step of applying a non-linear function to at least one of the signals.

10. A method as claimed in claim 1, wherein at least one signal is processed in a predetermined manner to produce an output varying according to an expected variation in a further signal, and this output is compared with said further signal to produce an error signal indicative of variations from said predetermined relationship.

11. A method as claimed in claim 10, wherein a plurality of signals are processed to produce the output varying according to an expected variation in the further signal.

12. A method as claimed in claim 1, the method including the step of determining whether the predetermined relationship is maintained between contemporaneous values of the varying signals.

13. A method as claimed in 1, wherein the method includes the step of determining whether the predetermined relationship is maintained between values of at least one varying signal and subsequently-occurring values of at least one other varying signal.

14. A method as claimed in claim 13, including the step of controlling the delay between the values between which the predetermined relationship is determined in accordance with the scanning of the coin.

15. A method as claimed in claim 1, including the step of checking for different predetermined relationships each associated with a respective coin denomination.

16. A method as claimed in claim 1, when used to validate coins moving under gravity past one or more sensors.

17. A method as claimed in claim 1, wherein at least one of the signals is derived from an electromagnetic sensor.

18. A method as claimed in claim 1, when used for validating bicolour coins.

19. A method of validating a coin, the method comprising determining whether a predetermined relationship is maintained between corresponding parts of at least three varying signals that occur during periods when the signals are varying, wherein each of the signals is derived from a sensor scanning the coin.

20. A coin validator having sensing means for scanning a coin and providing at least two varying signals representing measurements of different characteristics of a coin, and means to determine whether a predetermined relationship is maintained between corresponding parts of said signals that occur during periods when the signals are varying.

21. A coin validator having sensing means for producing at least two varying signals in response to a coin being scanned by the sensing means, and determining means for determining whether corresponding parts of the signals maintain a predetermined relationship with each other throughout periods when the signal values are varying, and for producing a signal indicative of validity in dependence on the results of said determination.

* * * * *